US008240291B2

(12) United States Patent
Ibrahim et al.

(10) Patent No.: US 8,240,291 B2
(45) Date of Patent: Aug. 14, 2012

(54) PRESSURE RELIEF VALVE

(75) Inventors: Daniel R. Ibrahim, Metamora, IL (US); Scott F. Shafer, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 364 days.

(21) Appl. No.: 12/604,612

(22) Filed: Oct. 23, 2009

(65) Prior Publication Data

US 2011/0094476 A1 Apr. 28, 2011

(51) Int. Cl.
*F02M 59/36* (2006.01)

(52) U.S. Cl. ..... 123/458

(58) Field of Classification Search ..... 123/456, 123/457, 458, 506; 137/115.14, 118.06
See application file for complete search history.

(56) References Cited

U.S. PATENT DOCUMENTS

| | | | | |
|---|---|---|---|---|
| 3,339,579 | A | 9/1967 | Lewis et al. | |
| 3,346,009 | A | 10/1967 | Lindeboom | |
| 3,604,446 | A * | 9/1971 | Brooks | 137/115.03 |
| 3,785,393 | A * | 1/1974 | Tanguy | 137/110 |
| 3,837,354 | A * | 9/1974 | Farr | 137/118.06 |
| 4,170,243 | A | 10/1979 | Richter | |
| RE30,261 | E * | 4/1980 | Brand | 137/115.15 |
| 4,232,701 | A * | 11/1980 | Adachi | 137/101 |
| 4,456,028 | A | 6/1984 | Watson | |
| 4,577,606 | A | 3/1986 | Bohringer et al. | |
| 4,620,560 | A * | 11/1986 | Coutant | 137/115.14 |
| 4,664,137 | A * | 5/1987 | Leorat et al. | 137/118.06 |
| 4,745,903 | A | 5/1988 | Gmelin | |
| 5,295,469 | A | 3/1994 | Kariya et al. | |
| 5,529,042 | A | 6/1996 | Augustin et al. | |
| 5,558,063 | A * | 9/1996 | Minagawa et al. | 123/457 |
| 5,983,863 | A | 11/1999 | Cavanagh et al. | |
| 6,095,190 | A | 8/2000 | Wilcox et al. | |
| 6,116,217 | A * | 9/2000 | Klopfer | 123/467 |
| 6,209,527 | B1 | 4/2001 | Bueser et al. | |
| 6,244,253 | B1 | 6/2001 | Haeberer et al. | |
| 6,253,734 | B1 | 7/2001 | Rembold et al. | |
| 6,328,535 | B1 * | 12/2001 | Brighton et al. | 417/220 |

(Continued)

FOREIGN PATENT DOCUMENTS

DE 1148511 5/1963

(Continued)

OTHER PUBLICATIONS

English-language Abstract of DE 28 18 581 A1, Oct. 1979.

(Continued)

*Primary Examiner* — Thomas Moulis
(74) *Attorney, Agent, or Firm* — Miller, Matthias & Hull

(57) ABSTRACT

A pressure relief valve is disclosed. The pressure relief valve comprises a body, a valve member, and a resilient member. The body includes a guide bore, a seat surface, an inlet, a first outlet, and a second outlet. The valve member is received within a portion of the body and includes a guide portion received within the guide bore, a valve seat configured to sealingly engage the seat surface, and an internal passage. The resilient member biases the valve seat into engagement with the seat surface. The valve member is moveable between a first position in which the inlet is fluidly blocked from the first outlet and the second outlet, a second position in which inlet is fluidly coupled to the first outlet but not to the second outlet, and a third position in which the inlet is fluidly coupled to the first outlet and the second outlet.

16 Claims, 4 Drawing Sheets

U.S. PATENT DOCUMENTS

| | | | | |
|---|---|---|---|---|
| 6,352,085 | B1 * | 3/2002 | Morita et al. | 137/516.27 |
| 6,422,203 | B1 | 7/2002 | Djordjevic | |
| 6,446,613 | B1 | 9/2002 | Djordjevic | |
| 6,536,413 | B2 | 3/2003 | Mori | |
| 6,546,913 | B2 * | 4/2003 | Hopley | 123/457 |
| 6,591,812 | B2 | 7/2003 | Augustin | |
| 6,604,507 | B1 | 8/2003 | Lei et al. | |
| 6,622,701 | B2 | 9/2003 | Endo | |
| 6,622,752 | B2 | 9/2003 | Kushida et al. | |
| 6,637,408 | B2 | 10/2003 | Djordjevic | |
| 6,675,744 | B1 | 1/2004 | Levan | |
| 6,715,468 | B2 | 4/2004 | Uchiyama et al. | |
| 6,776,140 | B2 | 8/2004 | Maier et al. | |
| 6,792,919 | B2 | 9/2004 | Kohketsu et al. | |
| 6,874,475 | B2 | 4/2005 | Katsura et al. | |
| 6,976,474 | B1 | 12/2005 | Coldren et al. | |
| 7,273,041 | B2 * | 9/2007 | Larsson et al. | 123/516 |
| 7,634,986 | B2 * | 12/2009 | Kuroda et al. | 123/457 |
| 7,878,179 | B2 * | 2/2011 | Ikeya | 123/457 |
| 2007/0079878 | A1 | 4/2007 | Buchberger et al. | |

FOREIGN PATENT DOCUMENTS

| | | | |
|---|---|---|---|
| DE | 2818581 | | 10/1979 |
| DE | 3148454 | | 6/1982 |
| DE | 3508986 | | 9/1985 |
| DE | 8711115.2 | | 11/1987 |
| DE | 19604889 | C2 | 8/1997 |
| DE | 19955083 | A1 | 5/2001 |
| DE | 10129822 | A1 | 1/2003 |
| EP | 0241952 | | 10/1987 |
| EP | 0305177 | | 3/1989 |
| EP | 1403509 | A2 | 3/2004 |
| GB | 2116293 | | 9/1983 |
| WO | 02077446 | A1 | 10/2002 |
| WO | 2006037693 | A1 | 4/2004 |

OTHER PUBLICATIONS

English-language Abstract of DE 31 48 454 A1, Jun. 1982.
English-language Abstract of DE 35 08 986 A1, Sep. 1985.
English-language Abstract of DE 196 04 889 C2, Aug. 1997.
English-language Abstract of DE 199 55 083 A1, May 2001.

* cited by examiner

PRESSURE RELIEF VALVE

TECHNICAL FIELD

The present disclosure is directed to a pressure relief valve and, more particularly, to a multi-stage pressure relief valve.

BACKGROUND

Many different fuel systems are utilized to introduce fuel into the combustion chambers of an engine. One type of fuel system is known as the common rail system. A typical common rail fuel system utilizes one or more pumping mechanisms to pressurize fuel and direct the pressurized fuel to a common manifold also known as the common rail. Individual injectors draw pressurized fuel from the common rail and inject one or more shots of fuel per cycle into the combustion chambers. In order to optimize engine operation, fuel within the rail is maintained within a desired pressure range through the precise control of the pumping mechanisms.

Situations may arise in which this precise control is interrupted, pressure fluctuations or spikes occur, or various portions of the fuel system fail. In these situations, there is a possibility that fuel pressures within the common rail could reach levels that have the potential to damage the components of the fuel system. One way to protect the common rail from such excessive pressures is to selectively drain fuel from the common rail as the pressure of the fuel within it exceeds a predetermined maximum threshold value. However, if too much fuel is drained, the pressure of the fuel within the common rail may drop below a certain minimum pressure at which the fuel injectors and engine will be able to continue operating in at least a limited operational mode, or "limp home" mode, and the engine may shut off. If the engine shuts off suddenly, the machine, truck, or other piece of equipment the engine is powering may be left in an undesirable state, position, or location. Moreover, depending on the problem or problems that lead to the excessive pressure within the fuel system, the rate at which the fuel will need to be drained from the common rail to maintain the minimum pressure may vary.

The disclosed pressure relief valve is directed to overcoming one or more of the problems set forth above or other problems.

SUMMARY

According to one exemplary embodiment, a pressure relief valve comprises a body, a valve member, and a resilient member. The body includes a guide bore, a seat surface, an inlet, a first outlet, and a second outlet. The valve member is received within at least a portion of the body and includes a guide portion slideably received within the guide bore, a valve seat configured to sealingly engage the seat surface, and an internal passage. The resilient member is coupled between the body and the valve member and biases the valve seat of the valve member into engagement with the seat surface of the body. The valve member is moveable between a first position in which the valve seat is sealingly engaged with the seat surface and the inlet is fluidly blocked from the first outlet and the second outlet, a second position in which the valve seat is disengaged with the seat surface and the inlet is fluidly coupled to the first outlet but not to the second outlet, and a third position in which the inlet is fluidly coupled to the first outlet and the internal passage of the valve member fluidly couples the inlet to the second outlet.

According to another exemplary embodiment, a method for selectively directing a fluid from a first source at a first pressure to a second source at a second pressure lower than the first pressure comprises the step of maintaining a valve member in a first position, in which an inlet fluidly coupled to the first source is fluidly blocked from a first outlet fluidly coupled to the second source, until the first pressure reaches a first pressure threshold. The method also comprises the step of moving the valve member to a second position, in which the inlet is fluidly coupled to the first outlet, when the first pressure reaches the first pressure threshold. The method also comprises that step of moving the valve member from the second position to a third position, in which the inlet is fluidly coupled to the first outlet and to a second outlet separate from the first outlet and fluidly coupled to the second source, when a pressure acting on the valve member reaches a second pressure threshold.

According to another exemplary embodiment, a common rail fuel system comprises a high-pressure fuel pump, a common rail, a fuel injector, and a pressure relief valve. The high-pressure fuel pump is configured to be fluidly coupled to a source of fuel. The common rail is fluidly coupled to the high-pressure fuel pump. The fuel injector is fluidly coupled to the common rail. The pressure relief valve is fluidly coupled to the common rail and comprises a body, a valve member, and a resilient member. The body includes a guide bore, an inlet, a first outlet, and a second outlet. The guide bore includes a first end and a second end opposite the first end. The first outlet is fluidly coupled to the second end of the guide bore and is configured to be coupled to a drain. The second outlet is configured to be fluidly coupled to the drain and is fluidly coupled to the guide bore at a location between the first end and the second end. The inlet is fluidly coupled to the common rail and to the guide bore at a location between the first outlet and the second outlet. The valve member is received within at least a portion of the body and includes a guide portion slideably received within the guide bore, a recessed portion, a valve seat configured to sealingly engage the second end of the guide bore, and an internal passage extending from proximate the valve seat to the guide portion. The resilient member biases the valve member toward the second end of the guide bore. The valve member is moveable between a first position in which the valve seat of the valve member is sealingly engaged with the second end of the guide bore and the inlet is fluidly blocked from the first outlet and the second outlet, a second position in which the valve seat is disengaged with the second end of the guide bore and the inlet is fluidly coupled to the first outlet but not to the second outlet, and a third position in which the inlet is fluidly coupled to the first outlet and the internal passage of the valve member fluidly couples the inlet to the second outlet.

Although the drawings depict exemplary embodiments or features of the present disclosure, the drawings are not necessarily to scale, and certain features may be exaggerated in order to provide better illustration or explanation. The exemplifications set out herein illustrate exemplary embodiments or features, and such exemplifications are not to be construed as limiting the inventive scope in any manner.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts.

Figure 1:
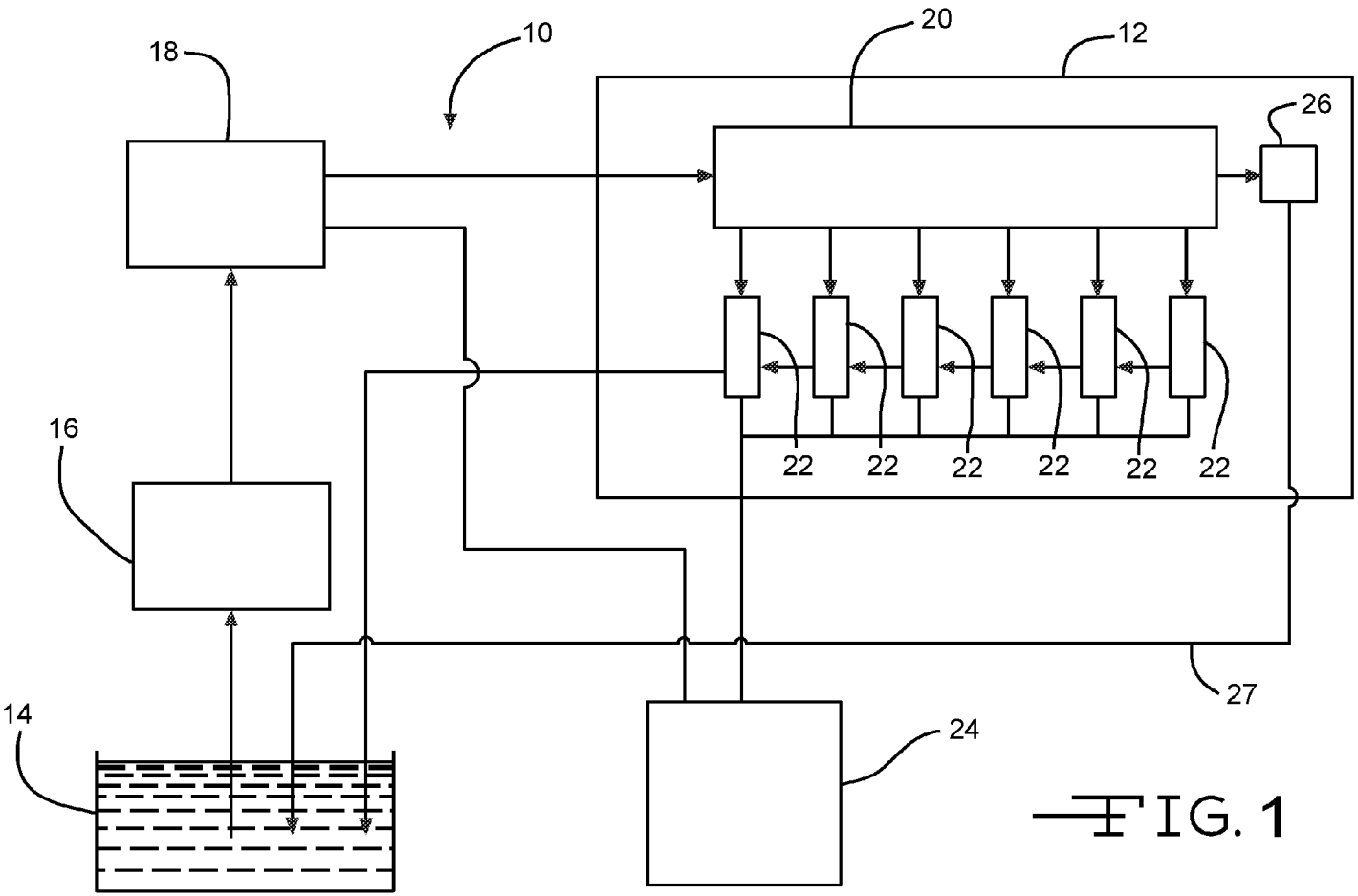
FIG. 1 is a schematic illustration of a fuel system according to one exemplary embodiment.

Referring generally to FIG. 1, a fuel system 10 is shown according to one exemplary embodiment. Fuel system 10 is a system of components that cooperate to deliver fuel (e.g., diesel, gasoline, heavy fuel, etc.) from a location where fuel is stored to the combustion chamber(s) of an engine 12 where it will combust and where the energy released by the combustion process will be captured by engine 12 and used to generate a mechanical source of power. Although depicted in FIG. 1 as a fuel system for a diesel engine, fuel system 10 may be the fuel system of any type of engine (e.g., an internal combustion engine such as a gaseous fuel or gasoline engine, a turbine, etc.). According to one exemplary embodiment, fuel system 10 includes a tank 14, a transfer pump 16, a high-pressure pump 18, a common rail 20, fuel injectors 22, an electronic control module (ECM) 24, and a pressure relief valve 26.

Tank 14 is a storage container or fluid source that stores the fuel that fuel system 10 will deliver. Transfer pump 16 pumps fuel from tank 14 and delivers it at a generally low pressure to high-pressure pump 18. High-pressure pump 18, in turn, pressurizes the fuel to a high pressure and delivers the fuel to common rail 20. Common rail 20, which is intended to be maintained at the high pressure generated by high-pressure pump 18, serves as the source of high-pressure fuel (e.g., fluid source) for each of fuel injectors 22. Fuel injectors 22 are located within engine 12 in a position that enables fuel injectors 22 to inject high-pressure fuel into the combustion chambers of engine 12 (or into pre-chambers or ports upstream of the combustion chamber in some cases) and generally serve as metering devices that control when fuel is injected into the combustion chamber, how much fuel is injected, and the manner in which the fuel is injected (e.g., the angle of the injected fuel, the spray pattern, etc.). Each fuel injector 22 is continuously fed fuel from common rail 20 such that any fuel injected by a fuel injector 22 is quickly replaced by additional fuel supplied by common rail 20. ECM 24 is a control module that receives multiple input signals from sensors associated with various systems of engine 12 (including fuel system 10) and indicative of the operating conditions of those various systems (e.g., common rail fuel pressure, fuel temperature, throttle position, engine speed, etc.). ECM 24 uses those inputs to control, among other engine components, the operation of high-pressure pump 18 and each of fuel injectors 22. The general purpose of fuel system 10 is to ensure that the fuel is constantly being fed to engine 12 in the appropriate amounts, at the right times, and in the right manner to support the operation of engine 12.

Figure 2:
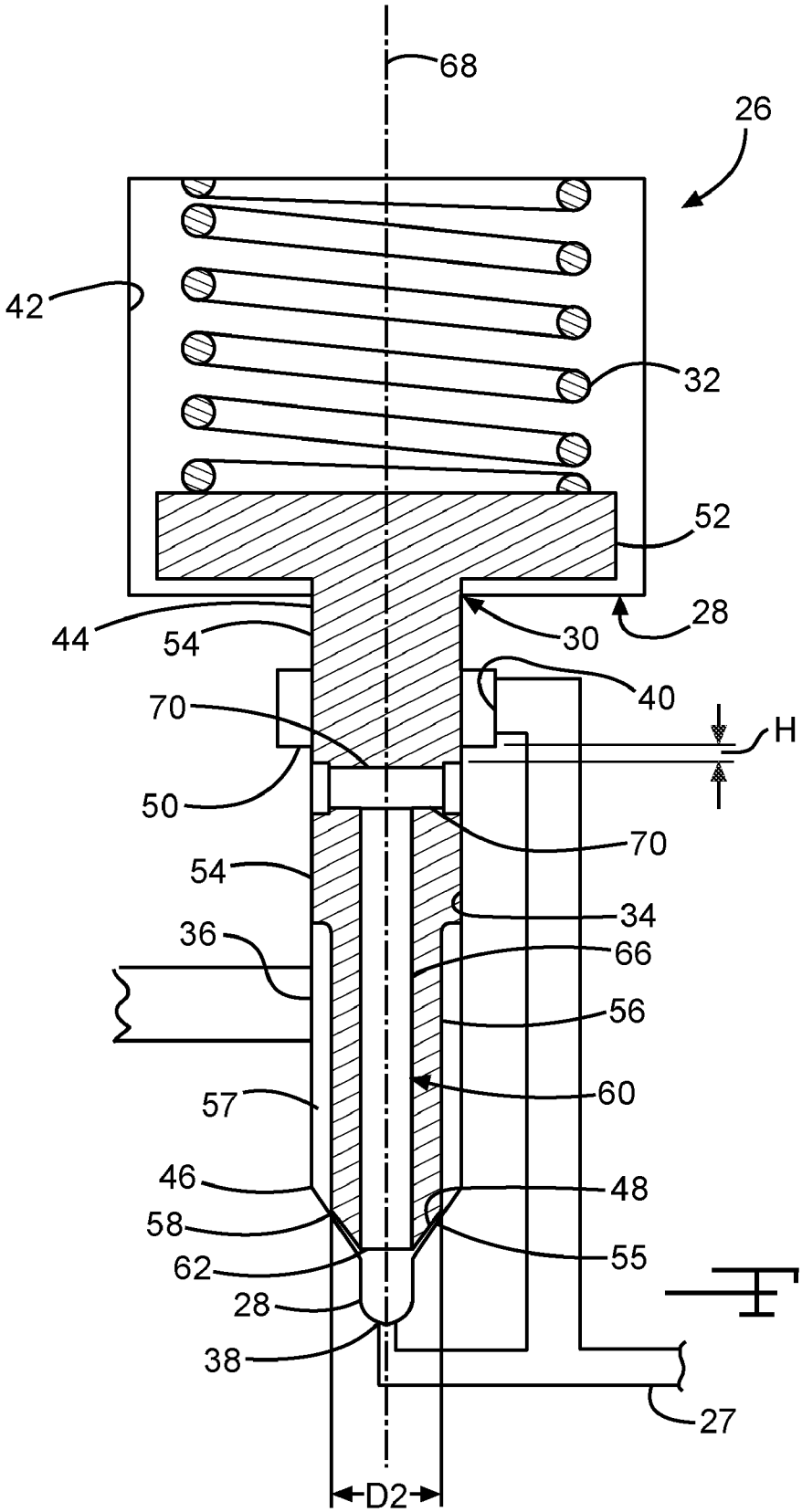
FIG. 2 is a diagrammatic illustration of a pressure relief valve according to one exemplary embodiment where the pressure relief valve is shown in a closed position.

Referring now to FIG. 2, pressure relief valve 26 is an apparatus or assembly that selectively directs fuel from common rail 20 to tank 14 when the pressure of the fuel within common rail 20 exceeds a certain threshold magnitude, which will depend on the characteristics of each particular fuel system. According to one exemplary embodiment, pressure relief valve 26 includes a body 28, a valve member 30, and a resilient member 32.

Body 28 is a generally rigid member or assembly that receives valve member 30 and resilient member 32 and that defines flow passages that allow fuel to flow from a high pressure region (e.g., common rail 20) to a low pressure region (e.g., tank 14). According to one exemplary embodiment, body 28 includes a bore 34, an inlet 36, a first outlet 38, a second outlet 40, and a spring chamber 42.

Bore 34 is a generally cylindrical chamber or opening within body 28 that is configured to receive at least a portion of valve member 30. Bore 34 includes an end 44 that is located near spring chamber 42 and an opposite end 46. Near end 46, bore 34 includes a seat surface 48 that is configured to be engaged by a portion of valve member 30 to create a sealed interface that prevents (or substantially prevents) any flow of fluid from around valve member 30 into first outlet 38. According to one exemplary embodiment, seat surface 48 is a generally conical surface that is configured to engage a corresponding surface on valve member 30. According to other alternative embodiments, the seat surface may take any one of a variety of different configurations that are suitable for engagement with the corresponding portion of valve member 30.

Inlet 36 is a passageway, duct, or opening within body 28 that opens into bore 34 and that serves to fluidly couple the source of high pressure fuel (e.g, common rail 20) to bore 34. According to one exemplary embodiment, inlet 36 enters bore 34 in a radial direction. First outlet 38 is a passageway, duct, or opening within body 28 that serves to fluidly couple bore 34 to a low pressure reservoir, drain, or fluid source (e.g., tank 14) such as, for example, via a drain line 27. According to one exemplary embodiment, first outlet 38 is located near end 46 of bore 34 and is positioned on the opposite side of seat surface 48 than inlet 36 such that the engagement of valve member 30 with seat surface 48 fluidly blocks inlet 36 from first outlet 38. Second outlet 40 is a passageway, duct, or opening within body 28 that serves to fluidly couple bore 34 to a low pressure reservoir, drain, or fluid source (e.g., tank 14) such as, for example, via drain line 27. According to one exemplary embodiment, second outlet 40 is located generally near end 44 of bore 34 such that along the length of bore 34, inlet 36 is located between first outlet 38 and second outlet 40. To facilitate the flow of fuel into second outlet 40 from different positions around the circumference of bore 34, an annulus or circumferential groove 50 may be provided within bore 34. Spring chamber 42 is an opening or cavity within body 28 that is configured to receive a portion of valve member 30 and resilient member 32. According to one exemplary embodiment, spring chamber 42 extends from end 44 of bore 34.

According to various alternative and exemplary embodiments, the body may take one of a multitude of different forms or shapes, or be provided in a variety of different sizes, that make it suitable for incorporation into a particular fuel system or other fluid system or suitable for placement within a certain physical space. For example, the body may include one or more different interfaces or engagements points (e.g., threaded interfaces, etc.) that allow it to be fluidly coupled to one or more other fluid system components. The body may also include one or more brackets, flanges, projections, recesses, grooves, or other structures that facilitate the physical coupling of the body to one or more other structures, such as an engine, the common rail, a frame member, or other structures. According to other exemplary and alternative embodiments, the body may be constructed from a single unitary piece or it may be formed from two or more elements or structures coupled together.

Valve member 30 is a generally rigid member that is configured to slide within bore 34 to selectively couple inlet 36 with first outlet 38 or with both first outlet 38 and second outlet 40. According to one exemplary embodiment, valve member 30 includes a head 52, a guide portion 54, a recessed portion 56, a valve seat 58, and an internal passage 60.

Head 52 is a generally enlarged portion of valve member 30 that is configured to engage resilient member 32 to allow valve member 30 to be biased in a particular direction. Head 52 may also serve as a portion of valve member 30 that engages a stop surface on, or coupled to, body 28 that limits the extent to which valve member 30 may move or "lift" within bore 34. Guide portion 54 extends from head 52 and includes a generally cylindrical surface that engages the surface of body 28 that defines bore 34 to facilitate the movement of valve member 30 within bore 34. Guide portion 54 has a diameter $D_1$ that allows valve member 30 to slide within bore 34 and at the same time allows for the creation of a substantially fluid tight seal between guide portion 54 and the surface of body 28 defining bore 34. Recessed portion or region 56 extends from guide portion 54 and forms a reduced diameter portion of valve member 30 that creates a flow passage or volume 57 between valve member 30 and the corresponding surface of bore 34. Valve seat 58 is provided on the end of recessed region that is opposite guide portion 54. Valve seat 58 is configured to engage seat surface 48 of bore 34 to form a seal between valve member 30 and seat surface 48 such that substantially no fluid leaks from the region around recessed region 56 past valve member 30 and into first outlet 38. When engaged, valve seat 58 and seat surface 48 define an engagement area or ring 55 beyond which fluid from within flow passage 57 cannot pass. Engagement area 55 has a diameter $D_2$ that is less than diameter $D_1$ of guide portion 54. Internal passage 60 is a duct, channel, or passage that begins at an end 62 of valve member 30, that extends beyond recessed region 56, and that exits valve member 30 from guide portion 54. At end 62, internal passage 60 is provided within diameter $D_2$ such that high pressure fluid from the volume surrounding recessed region 56 is not able to pass into passage 60 when valve seat 58 and seat surface 48 are engaged. According to one exemplary embodiment, internal passage 60 includes an axial portion 66, which extends generally along a longitudinal axis 68 of valve member 30 from end 62 to a point along axis 68 that corresponds to guide portion 54, and at least one radial portion 70 that extends radially outwardly from the end of axial portion 66. According to various exemplary and alternative embodiments, the valve member may include more than one internal passage, and each internal passage may include more than one radial portions. For example, the internal passage may include two radial portions (e.g., such as would be created with a diametral drilling), three radial portions, four radial portions, or more than four radial portions. According to other exemplary and alternative embodiments, the internal passages may take other configurations. For example, the internal passage could be formed from a single or from multiple straight bores that extend diagonally from end 62 to a portion of guide portion 54. According to other various exemplary and alternative embodiments, the valve member may be constructed from a single unitary piece or it may be formed from two or more elements or structures coupled together.

Resilient member or element 32 is a resilient element or assembly that biases valve member 30 toward the position in which valve seat 58 of valve member 30 engages seat surface 48 of body 28 and that allows valve member 30 to lift (and thereby disengage valve seat 58 from seat surface 48) when acted upon by a certain predetermined pressure. According to one exemplary embodiment, resilient member 32 is a helical compression spring. According to other exemplary and alternative embodiments, the resilient member may be any element, member, or apparatus that serves to bias valve member 30 toward seat surface 48 such that the bias may be overcome when valve member 30 is subjected to a certain predetermined pressure.

INDUSTRIAL APPLICABILITY

For a variety of different reasons, many fluid systems, including different types of fuel systems, are susceptible to pressure spikes or may otherwise experience situations where pressures could be generated within the system that are of a sufficient magnitude to damage the fluid system or lead to undesired performance consequences. The incorporation of pressure relief valve 26 into such a system may help to mitigate, reduce, or even eliminate the adverse effects of excessive fluid pressure on the fluid system. When the pressure of the fluid within the system exceeds a maximum threshold value, pressure relief valve 26 may drain fluid from the system, thereby lowering the pressure of the fluid within the system. The pressure of the fluid within the system may be lowered just enough to protect the system without creating instability or completely disabling the system. The operation of pressure relief valve 26 will now be explained in connection with fuel system 10.

During operation of fuel system 10, transfer pump 16 draws fluid from tank 14 and provides the fuel to high pressure pump 18. High pressure pump 18 then pressurizes the fuel to a high pressure and directs the high pressure fuel to common rail 20. The fuel is then directed from common rail 20 to each of fuel injectors 22. Pressure relief valve 26 may be coupled within fuel system 10 such that inlet 36 is in fluid communication with the fuel within common rail 20 and first outlet 38 and second outlet 40 are both ultimately coupled to tank 14 (such as through drain line 27 as shown in FIG. 1).

Figure 3:
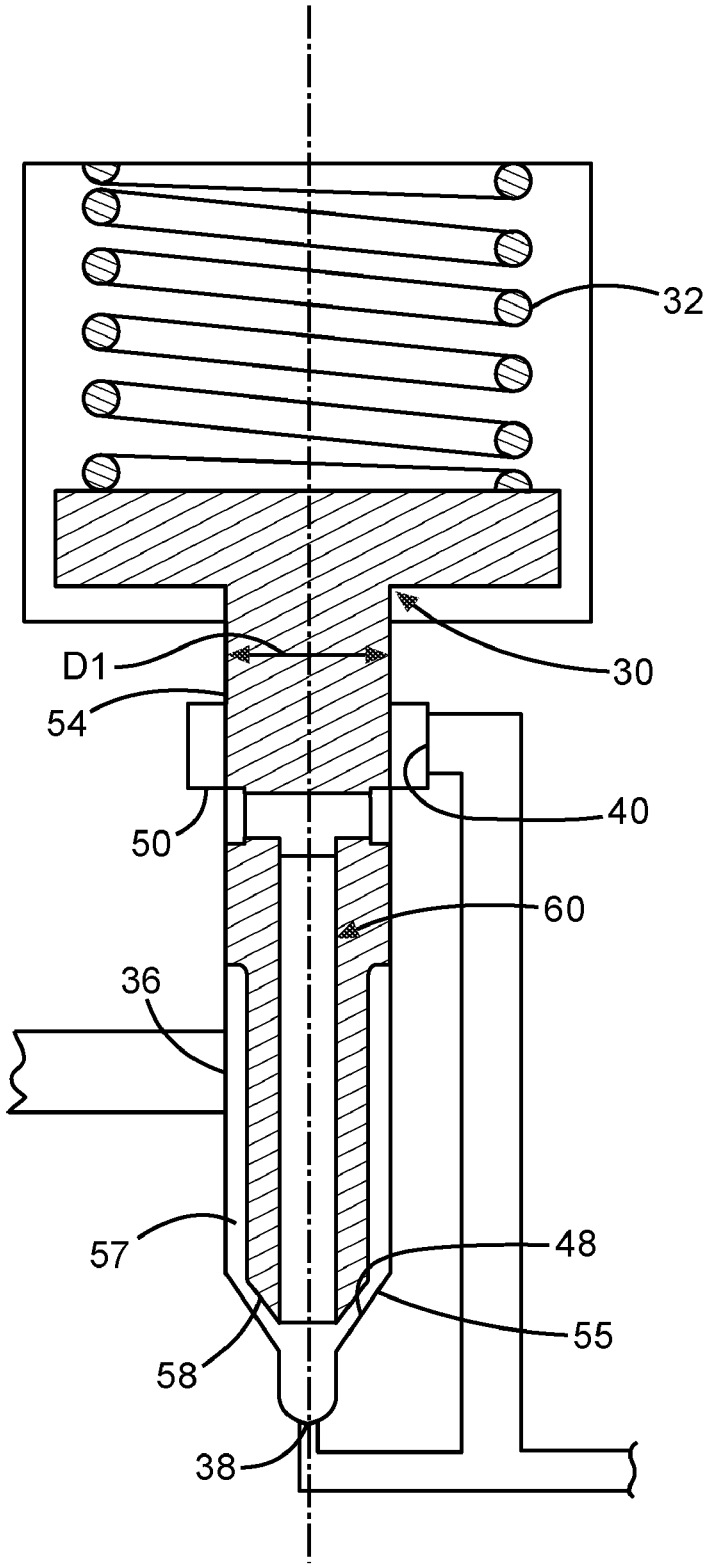
FIG. 3 is a diagrammatic illustration of the pressure relief valve of FIG. 2 shown in a second position.

Because inlet 36 is coupled to common rail 20, fuel from common rail 20 will enter into bore 34 from inlet 36 and will fill the volume defined by the wall defining bore 34, recessed region 56, and engagement area 55 (e.g., flow passage 57). When valve member 30 is in a closed position (illustrated in FIG. 2), in which valve seat 58 is engaged with seat surface 48 to substantially prevent the flow of fuel through engagement area 55, the force acting on valve member 30 against the bias provided by resilient member 32 will be equal to the pressure within flow passage 57 (which will be substantially equal to the pressure of the fuel within common rail 20) multiplied by the area over which the pressure acts. When valve member 30 is in the closed position, this area (referred to as "the opening area") will be equal to the area of guide portion 54 (having a diameter $D_1$) minus the area of engagement area 55 (having a diameter $D_2$). When the pressure within common rail 20 exceeds a certain threshold pressure (referred to as "the opening pressure"), which when multiplied by the opening area, generates an opening force that exceeds the biasing force provided by resilient member 32, valve member 30 will move away from seat surface 48 and the seal created by the engagement of valve seat 58 with seat surface 48 will be broken. When valve member 30 moves to this second position (illustrated in FIG. 3), in which the engagement of valve seat 58 with seat surface 48 has been broken, fuel from flow passage 57 is allowed to flow between valve seat 58 and seat surface 48 and drain into first outlet 38.

Figure 4:
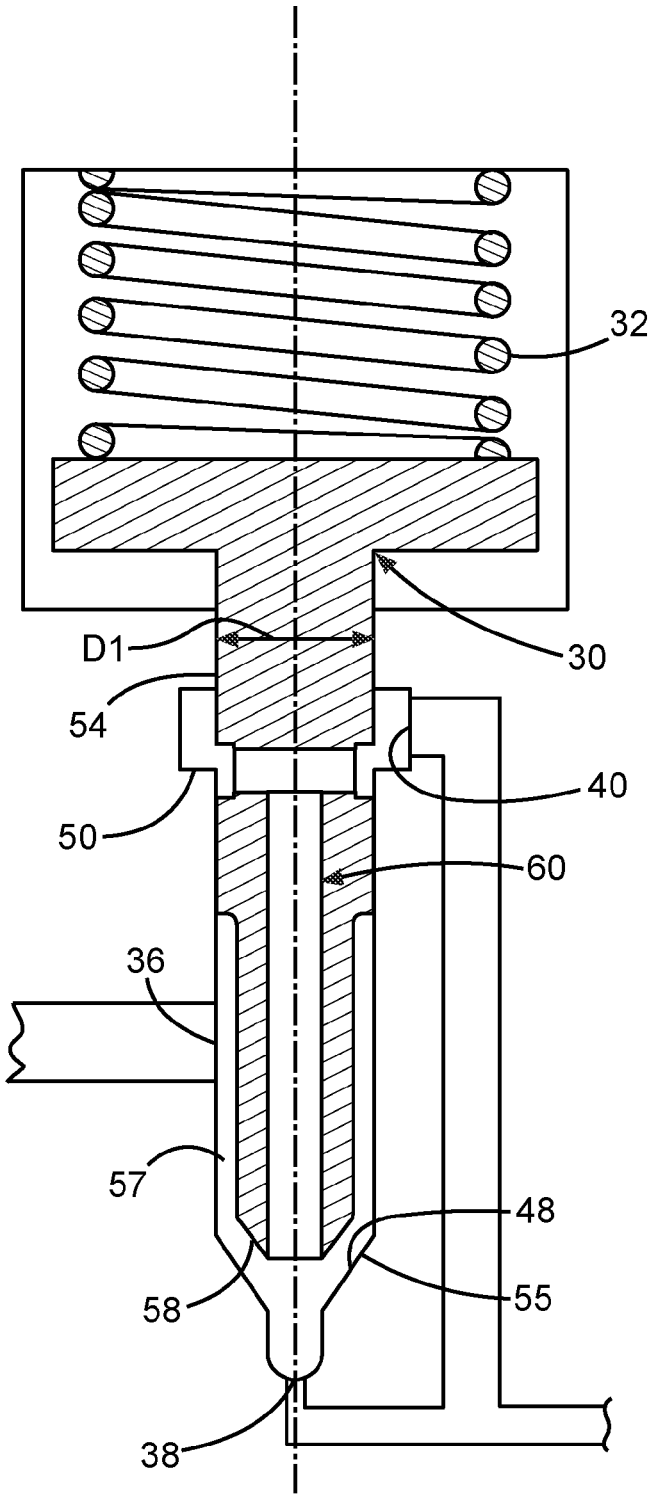
FIG. 4 is a diagrammatic illustration of the pressure relief valve of FIG. 2 shown in a third position.

When valve member 30 is in the second position, the force acting on valve member 30 against the bias provided by resilient member 32 will be equal to the pressure of the fuel under valve member 30 multiplied by the area over which the pressure acts. When valve member 30 is in the second position, this area (referred to as "the bore area") will be equal to the area of guide portion 54 (having a diameter $D_1$). Because the bore area (which includes the area of engagement area 55) is larger than the opening area, a pressure less than the opening pressure will be sufficient to overcome the biasing force provided by resilient member 32 and move valve member 30 farther away from seat surface 48. Depending on the characteristics of resilient member 32 (e.g., the spring constant k in the case of a compression spring), the flow of fuel trying to pass through pressure relief valve 26, and the size of first outlet 38, the pressure under valve member 30 may rise to a level that causes valve member 30 to move farther away from seat surface 48 until it travels a distance greater than distance H (see FIG. 2). When valve member 30 travels to this position, which will be referred to as the third position (illustrated in FIG. 4), it has lifted enough to allow internal passage 60 of valve member 30 to fluidly communicate with second outlet 40. Accordingly, when valve member 30 reaches the third position, at least some of the fuel traveling between seat surface 48 and valve seat 58 will be able to flow into internal passage 60 and then into second outlet 40. Thus, when valve member reaches the third position, a second outlet for fuel is created that makes it possible for a greater flow of fuel to pass through pressure relief valve 26 to tank 14. As valve member 30 continues to move away from seat surface 48, the area between internal passage 60 and second outlet 40 through which the fuel will be able to flow will increase as internal passage 60 becomes more aligned with second outlet 40. In this way, valve member 30 may function, at least partially, as a proportional valve.

Once valve member 30 is moved out of the first position, it will not close again until the force generated by the fuel pressure acting under valve member 30 over the bore area is less than the bias force provided by resilient member 32. The magnitude of the pressure that will allow valve member 30 to close (referred to as "the valve closing pressure") will depend on the biasing force provided by resilient member 32 and the size of the bore area. According to one exemplary embodiment, a resilient member and bore area are selected such that valve member 30 will close before the pressure of fuel within common rail 20 drops below a limp home pressure or pressure threshold that will not allow fuel injectors 22 to operate in at least a "limp home" mode.

Pressure relief valve 26 of the present disclosure is generally able to perform at least three operations. First, it allows fuel to pass through it and then to tank 14 (a low pressure drain) when the fuel pressure in common rail 20 exceeds a certain threshold pressure. This helps to ensure that the components of fuel system 10 are protected from damage caused by pressures that are higher than what fuel system 10 is intended or designed to withstand. Second, pressure relief valve 26 may be designed to have a valve closing pressure that allows valve member 30 to move back to its closed position before the fuel pressure within common rail 20 drops below a level that will prevent the fuel injectors (and the engine) from operating in at least a "limp home" or limited operational mode. This helps to ensure that the engine is able to continue operating, albeit in a limited operational mode, to give an operator the chance to move or otherwise operate the machine, truck, or other piece of equipment for which the engine is providing the power to a better location or point where the engine can be more conveniently shut down or serviced. Third, pressure relief valve 26 is able to provide the limp home pressure regulation function over a wider range of engine and high-pressure pump operating speeds and fuel flows by activating or utilizing second outlet 40 during situations when the flow rate of fuel through pressure relief valve 26 is greater than what first outlet 38 is capable of handling alone.

The operational characteristics of pressure relief valve 26 (e.g., valve opening pressure, valve closing pressure, etc.) may be adjusted by altering the parameters of resilient element 32, the area of guide portion 54, and the area of engagement area 55 to suit a particular application. For example, in one embodiment that may suitable for use with a common rail fuel system, diameter D1 of guide portion 54 of valve member 30 is 4 millimeters, diameter D2 of engagement area 55 is 3.3 millimeters, and resilient member 32 is a helical compression spring having a 940 Newton spring load. In this configuration, the valve opening pressure (e.g., the pressure that will cause valve member 30 to move from the closed position to the first position) is approximately 235 Megapascals and the valve closing pressure (e.g., the pressure that will allow valve member 30 to move back into the closed position) is approximately 75 Megapascals. In other alternative embodiments, the pressure relief valve may be configured to have different valve opening and valve closing pressures depending on the needs of the application in which the pressure relief valve is used.

Although pressure relief valve 26 has been described above in connection with a common rail fuel system, pressure relief valve 26 may also be used in any one of a variety of different fluid systems and with any one of a variety of different fluids. For example, the pressure relief valve may be used with other types of fuel systems, lubrication systems, work implement actuation systems, transmission systems, cooling systems, and other hydraulic systems where protection from excessive pressures may be desired.

It is important to note that the construction and arrangement of the elements of the pressure relief valve as shown in the exemplary and alternative embodiments is illustrative only. Although only a few embodiments of the pressure relief valve have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited. For example, elements shown as integrally formed may be constructed of multiple parts or elements shown as multiple parts may be integrally formed, the operation of the interfaces (e.g., the valve and seat, etc.) may be reversed or otherwise varied, and/or the length, width, diameter, or other dimensions of the structures and/or members or connectors or other elements of the system may be varied. It should be noted that the elements and/or assemblies of the pressure relief valve may be constructed from any of a wide variety of materials that provide sufficient strength or durability, and in any of a wide variety of combinations. It should also be noted that the pressure relief valve may be used in association with any of a wide variety of fluid systems or fluid subsystems in any of a wide variety of applications. Accordingly, all such modifications are intended to be included within the scope of the present disclosure. Other substitutions, modifications, changes and omissions may be made in the design, operating conditions and arrangement of the exemplary and alternative embodiments without departing from the spirit of the present disclosure.

What is claimed is:

1. A pressure relief valve comprising:

a body including a guide bore, a seat surface, an inlet, a first outlet, and a second outlet;

a valve member received within at least a portion of the body and including a guide portion slideably received within the guide bore, a valve seat configured to sealingly engage the seat surface, and an internal passage extending axially along the guide portion, at least one radial passage in fluid communication with the internal passage; and a resilient member coupled between the body and the valve member, the resilient member biasing the valve seat of the valve member into engagement with the seat surface of the body;

wherein the valve member is moveable between a first position in which the valve seat is sealingly engaged with the seat surface and the inlet is fluidly blocked from the first outlet and the second outlet, a second position in which the valve seat is disengaged with the seat surface and the inlet is fluidly coupled to the first outlet but not to the second outlet, and a third position in which the inlet is fluidly coupled to the first outlet and the internal passage of the valve member fluidly couples the inlet to the second outlet via the radial passage.

2. The pressure relief valve of claim 1, wherein the inlet is configured to be fluidly coupled to a fluid source at a first pressure and both the first outlet and the second outlet are configured to be fluidly coupled to a second fluid source at a second pressure less than the first pressure.

3. The pressure relief valve of claim 1, wherein the resilient member is a spring.

4. The pressure relief valve of claim 1, wherein the guide portion of the valve member has a first diameter and an engagement area between the valve seat and the seat surface has a second diameter smaller than the first diameter.

5. The pressure relief valve of claim 1, wherein the body further comprises a spring chamber.

6. The pressure relief valve of claim 5, wherein the valve member further comprises a head received within the spring chamber and wherein the resilient member engages the head.

7. The pressure relief valve of claim 1, wherein the interface between the guide portion of the valve member and the guide bore of the body forms a seal.

8. The pressure relief valve of claim 1, wherein the internal passage within the valve member extends from proximate the valve seat to the guide portion.

9. The pressure relief valve of claim 1, wherein the valve member further includes a recessed region between the guide portion and the valve seat.

10. The pressure relief valve of claim 9, wherein the inlet of the body is in fluid communication with the recessed region when the valve member is in the first position, the second position, and the third position.

11. The pressure relief valve of claim 1, wherein the guide bore includes a first end and a second end opposite the first end, the first outlet is fluidly coupled to the second end of the guide bore, the second outlet is fluidly coupled to the guide bore at a location between the first end and the second end, and the inlet is fluidly coupled to the guide bore at a location between the first outlet and the second outlet.

12. A common rail fuel system comprising:

a high-pressure fuel pump configured to be fluidly coupled to a source of fuel;

a common rail fluidly coupled to the high-pressure fuel pump;

a fuel injector fluidly coupled to the common rail; and a pressure relief valve fluidly coupled to the common rail, the pressure relief valve comprising:

a body including a guide bore, an inlet, a first outlet, and a second outlet, the guide bore including a first end and a second end opposite the first end, the first outlet being fluidly coupled to the second end of the guide bore and configured to be coupled to a drain, the second outlet being configured to be fluidly coupled to the drain and being fluidly coupled to the guide bore at a location between the first end and the second end, and the inlet being fluidly coupled to the common rail and to the guide bore at a location between the first outlet and the second outlet;

a valve member received within at least a portion of the body and including a guide portion slideably received within the guide bore, a recessed portion, a valve seat configured to sealingly engage the second end of the guide bore, and an internal passage extending from proximate the valve seat to the guide portion, the guide portion having at least one radial passage in fluid communication with the internal passage; and a resilient member biasing the valve member toward the second end of the guide bore;

wherein the valve member is moveable between a first position in which the valve seat of the valve member is sealingly engaged with the second end of the guide bore and the inlet is fluidly blocked from the first outlet and the second outlet, a second position in which the valve seat is disengaged with the second end of the guide bore and the inlet is fluidly coupled to the first outlet but not to the second outlet, and a third position in which the inlet is fluidly coupled to the first outlet and the internal passage of the valve member fluidly couples the inlet to the second outlet via the radial passage.

13. The common rail fuel system of claim 12, wherein the resilient member is a spring.

14. The common rail fuel system of claim 12, wherein the guide portion of the valve member has a first diameter and an engagement area between the valve seat of the valve member and the second end of the guide bore has a second diameter smaller than the first diameter.

15. The common rail fuel system of claim 12, wherein the interface between the guide portion of the valve member and the guide bore of the body forms a seal.

16. The common rail fuel system of claim 12, wherein the inlet of the body is in fluid communication with the recessed portion of the valve member when the valve member is in the first position, the second position, and the third position.

* * * * *

UNITED STATES PATENT AND TRADEMARK OFFICE

CERTIFICATE OF CORRECTION

PATENT NO. : 8,240,291 B2
APPLICATION NO. : 12/604612
DATED : August 14, 2012
INVENTOR(S) : Ibrahim et al.

It is certified that error appears in the above-identified patent and that said Letters Patent is hereby corrected as shown below:

In the Specification

Column 5, line 14, delete "$D_1$" and insert -- D1 --.

Column 5, line 30, delete "$D_2$" and insert -- D2 --.

Column 5, line 30, delete "$D_1$" and insert -- D1 --.

Column 5, line 34, delete "$D_2$" and insert -- D2 --.

Column 6, line 49, delete "$D_1$)" and insert -- D1) --.

Column 6, line 50, delete "$D_2$)." and insert -- D2). --.

Column 7, line 1, delete "$D_1$)." and insert -- D1). --.

Signed and Sealed this
Eighteenth Day of August, 2015

Michelle K. Lee

Michelle K. Lee
*Director of the United States Patent and Trademark Office*